US009010049B1

(12) United States Patent
Redman

(10) Patent No.: US 9,010,049 B1
(45) Date of Patent: Apr. 21, 2015

(54) PROTECTIVE TENT STAKE CAP

(71) Applicant: Joel Redman, Wayne, NJ (US)

(72) Inventor: Joel Redman, Wayne, NJ (US)

(73) Assignee: Argo Bag and Box, Inc., Wayne, NJ (US)

( * ) Notice: Subject to any disclaimer, the term of this patent is extended or adjusted under 35 U.S.C. 154(b) by 0 days.

(21) Appl. No.: 14/160,853

(22) Filed: Jan. 22, 2014

(51) Int. Cl.

| | |
|---|---|
| ***E04H 12/00*** | (2006.01) |
| ***E04H 15/10*** | (2006.01) |
| ***E04H 15/62*** | (2006.01) |
| ***E04H 15/00*** | (2006.01) |
| ***E04H 15/32*** | (2006.01) |
| ***F21S 8/08*** | (2006.01) |
| *E01F 9/016* | (2006.01) |

(52) U.S. Cl.
CPC ..... *E04H 15/32* (2013.01); *E01F 9/0165* (2013.01); *F21S 8/081* (2013.01)

(58) Field of Classification Search
CPC ..... F21S 8/081; F21S 48/155; F21S 8/088; F21S 9/02; B60Q 7/00; F21W 2111/00; F21W 2131/10; F21W 2121/00; E01F 9/0165; F21V 21/0824; F21L 11/00; Y10S 362/802
USPC ..... 52/300, 301; 135/118, 120.4, 91
See application file for complete search history.

(56) References Cited

U.S. PATENT DOCUMENTS

| | | | | | |
|---|---|---|---|---|---|
| 963,826 | A | * | 7/1910 | Stonebridge | 362/162 |
| 1,435,002 | A | * | 11/1922 | Goodwin et al. | 362/294 |
| 2,790,257 | A | * | 4/1957 | Ware | 40/645 |
| 2,949,531 | A | * | 8/1960 | Lemelson | 362/253 |
| 3,866,034 | A | * | 2/1975 | Russo | 362/152 |
| 3,998,519 | A | * | 12/1976 | Martin | 439/859 |
| 4,142,179 | A | * | 2/1979 | Lowndes | 340/321 |
| 4,156,902 | A | * | 5/1979 | Wandler | 362/307 |
| 4,272,802 | A | * | 6/1981 | Steadman | 362/385 |
| 4,507,528 | A | * | 3/1985 | Vogel et al. | 200/302.2 |
| 4,564,890 | A | * | 1/1986 | Poyer | 362/216 |
| 4,703,403 | A | * | 10/1987 | Smith et al. | 362/268 |
| 4,984,139 | A | * | 1/1991 | Goggia | 362/153.1 |
| 5,197,506 | A | * | 3/1993 | Morin | 135/118 |
| 5,216,948 | A | * | 6/1993 | Sheppard et al. | 99/483 |
| 5,280,417 | A | * | 1/1994 | Hall et al. | 362/640 |
| 5,294,924 | A | * | 3/1994 | Dydzyk | 340/908.1 |

(Continued)

FOREIGN PATENT DOCUMENTS

WO WO2011146502 A1 11/2011

*Primary Examiner* — Phi A
*Assistant Examiner* — Omar Hijaz
(74) *Attorney, Agent, or Firm* — Thomas J. Germinario

(57) ABSTRACT

A water-tight, rigid plastic, domed, sphero-cylindrical protective cap is configured to be removably fitted over the convex head of a steel tent stake. The protective cap defines a sphero-cylindrical interior compartment that has a substantially flat circular base with an axial aperture. The protective cap is bilaterally hinged so that the interior compartment can be opened and the axial aperture bifurcated so as to accept the stake head for insertion through the base and enclosure within the interior compartment when the cap is closed. The bilaterally hinged structure of the cap enables it to be easily attached and removed from the tent stake, so that it can be taken off and replaced when the tent is being moved. This avoids a major problem of non-removable stake caps, which become deformed when the stakes are pulled up and hammered back into the ground. In some embodiments, to enhance visibility, the upper dome of the protective cap is translucent or transparent and includes within its interior one or more light-emitting diodes (LEDs).

6 Claims, 5 Drawing Sheets

(56) References Cited

U.S. PATENT DOCUMENTS

| | | | | |
|---|---|---|---|---|
| 5,319,365 | A * | 6/1994 | Hillinger | 340/908.1 |
| 5,687,772 | A | 11/1997 | Underwood | |
| 5,829,913 | A | 11/1998 | Puckett | |
| 6,003,257 | A * | 12/1999 | Stokes | 40/610 |
| 6,286,450 | B1 * | 9/2001 | Murrin et al. | 116/209 |
| 6,649,825 | B2 | 11/2003 | Rapp | |
| 6,691,479 | B1 * | 2/2004 | Tscharner | 52/301 |
| 6,758,767 | B1 | 7/2004 | Wang | |
| 7,322,720 | B1 * | 1/2008 | Haddad | 362/309 |
| 8,714,174 | B1 * | 5/2014 | DeSousa | 135/118 |
| 2008/0000513 | A1 * | 1/2008 | Yul et al. | 136/245 |

* cited by examiner

PROTECTIVE TENT STAKE CAP

BACKGROUND OF THE INVENTION

The present invention relates to protective end caps for covering exposed ends of tent stakes, and more particularly to tent stake caps which are configured to provide enhanced visibility.

Large tents are typically secured around their perimeters by steel tent stakes, comprising a conical point, a cylindrical shank and a convex head. Tent stakes are usually driven into the ground by repeated hammering of the stake head with a sledge hammer, which often causes the head to develop sharp burrs over time. For safety purposes, it is desirable to minimize the tripping hazards associated with tent stakes by increasing their visibility and providing protection from abrasive contact with burred stake heads. This can be done by providing a protective cover or cap that fits over the stake head, similar to protective caps used on the ends of exposed rebar on construction sites. Optimally, such tent stake caps should be readily attachable and removable, and should incorporate enhanced visibility features.

SUMMARY OF THE INVENTION

The present invention comprises a water-tight, rigid plastic, domed, sphero-cylindrical protective cap, which is configured to be removably fitted over the convex head of a steel tent stake having a substantially cylindrical or tapered cylindrical shank. The protective cap defines a sphero-cylindrical interior compartment that has a substantially flat circular base with an axial aperture which accesses the interior compartment and has a diameter that is less than that of the stake head but greater than that of the stake shank. The protective cap is bilaterally hinged so that the interior compartment can be opened and the axial aperture bifurcated so as to accept the stake head for insertion through the base and enclosure within the interior compartment when the cap is closed. The protective cap is secured in the closed configuration enclosing the stake head by a connective latch or catch mechanism between the bilateral shells opposite the hinge.

The bilaterally hinged structure of the cap enables it to be easily attached and removed from the tent stake, so that it can be taken off and replaced when the tent is being moved. This avoids a major problem of non-removable stake caps, which become deformed when the stakes are pulled up and hammered back into the ground.

In some embodiments, to enhance visibility, the upper dome of the protective cap is translucent or transparent and includes within its interior one or more light-emitting diodes (LEDs). The LEDs can be activated by contact of a button-type switch above the aperture in the interior compartment with the inserted tent stake head, such that the switch closes a circuit between the LEDs and one or more electrical power sources within the interior compartment, such as batteries. Alternately or additionally, the LEDs can be controlled by switch on the exterior of the protective cap, which switch can include a light sensor that automatically turns the LEDs off during daylight hours. In some of the lighted embodiments, the bilateral hinged separation of the protective cap is asymmetrical, thereby providing on one side of the cap a larger section of the interior within which a battery compartment is accommodated.

The foregoing summarizes the general design features of the present invention. In the following sections, specific embodiments of the present invention will be described in some detail. These specific embodiments are intended to demonstrate the feasibility of implementing the present invention in accordance with the general design features discussed above. Therefore, the detailed descriptions of these embodiments are offered for illustrative and exemplary purposes only, and they are not intended to limit the scope either of the foregoing summary description or of the claims which follow.

DETAILED DESCRIPTION OF THE PREFERRED EMBODIMENTS

Figure 1:
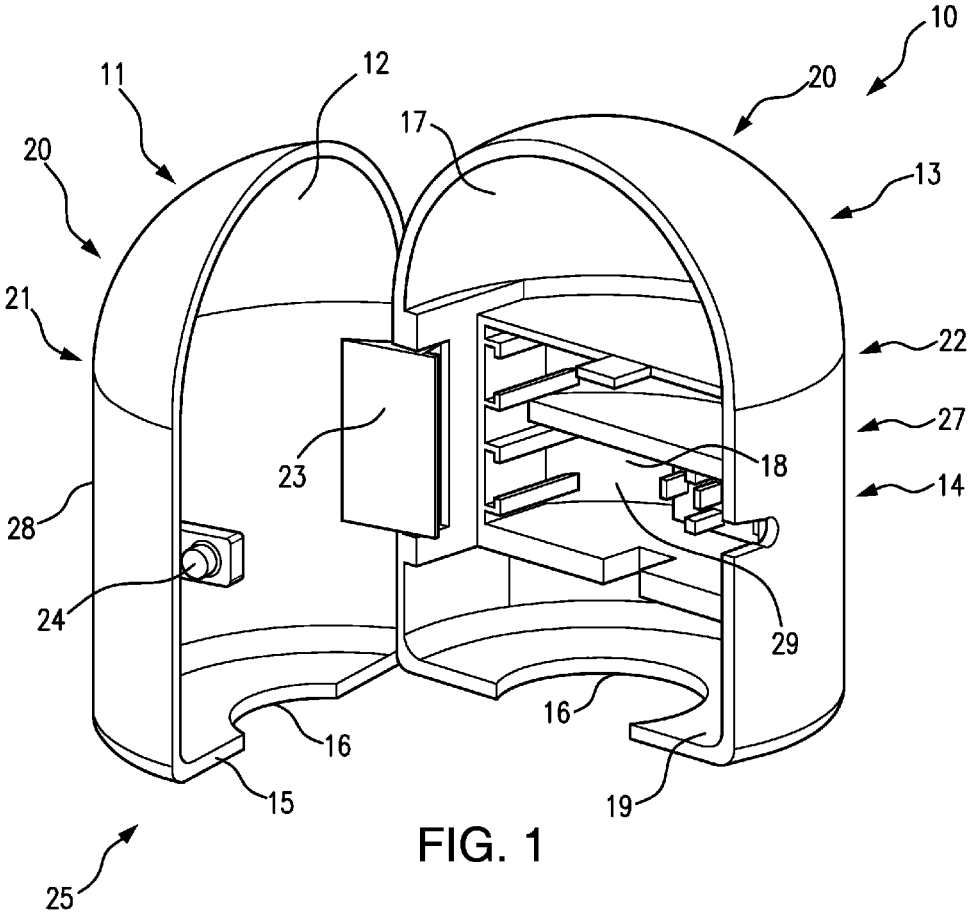
FIG. 1 is a perspective view of an exemplary protective tent stake cap in an open position.
Figure 5:
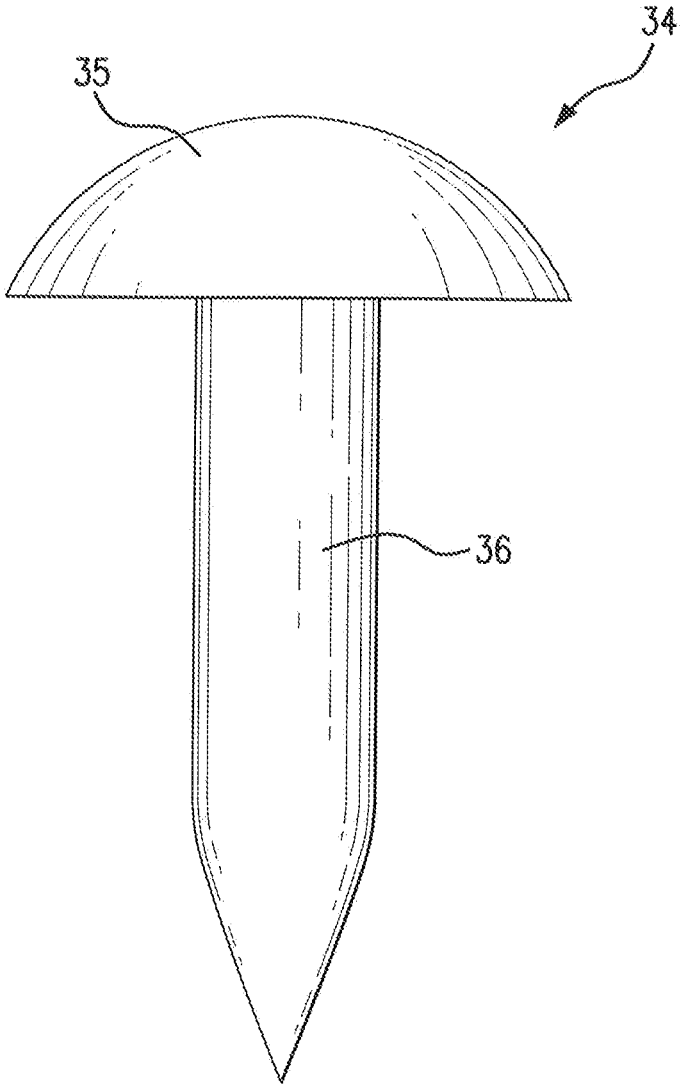
FIG. 5 is a front profile view of an exemplary tent stake.

Referring to FIGS. 1 and 5, one embodiment of the present invention 10 is a protective cap for a tent stake 34 having a convex stake head 35 and a substantially cylindrical or tapered cylindrical shank 36. The protective cap 10 comprises a rigid plastic, bilaterally-hinged, sphero-cylindrical enclosure 11 which defines a sphero-cylindrical interior compartment 12. The enclosure 11 comprises an upper dome 13, a cylindrical wall 14 and a flat circular base 15, which has a circular axial aperture 16 that accesses the interior compartment 12. The axial aperture 16 has a diameter that is less than the diameter of the stake head but greater than the diameter of the shank. The interior compartment 12 comprises an upper domed compartment space 17, a middle compartment space 18 and a base compartment space 19.

Figure 2:
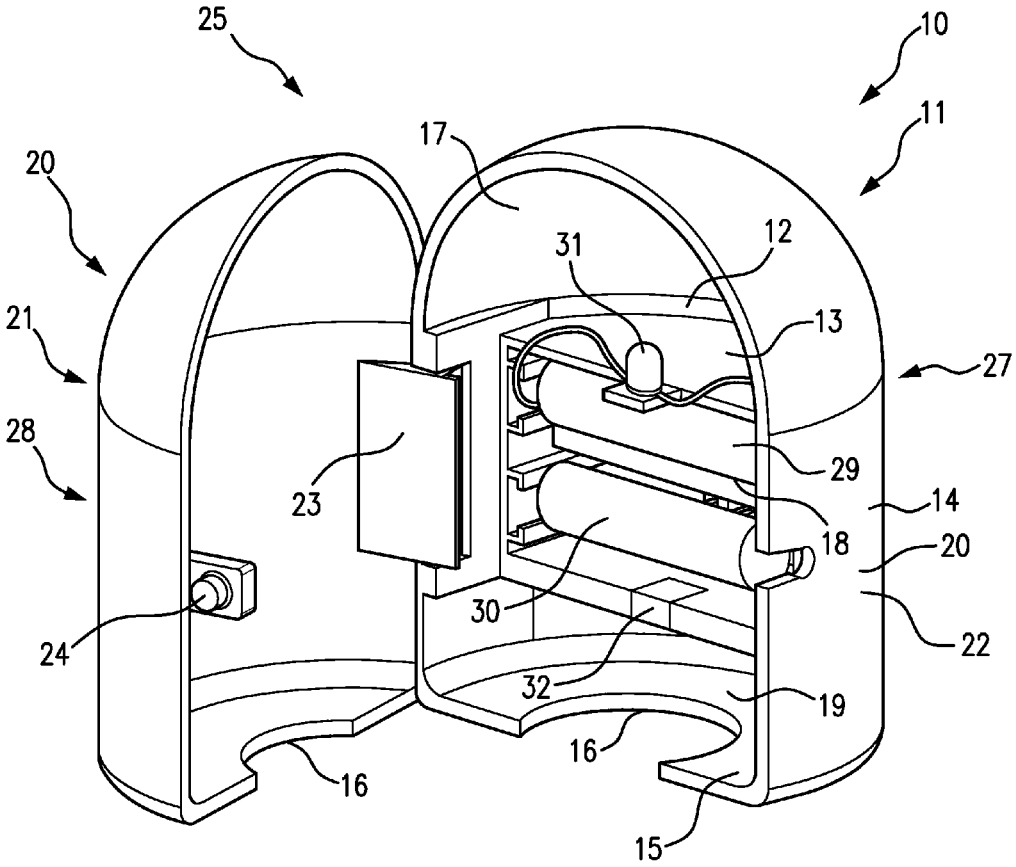
FIG. 2 is a perspective view of an exemplary protective tent stake cap in an open position with an interior LED light and interior button contact switch.
Figure 3:
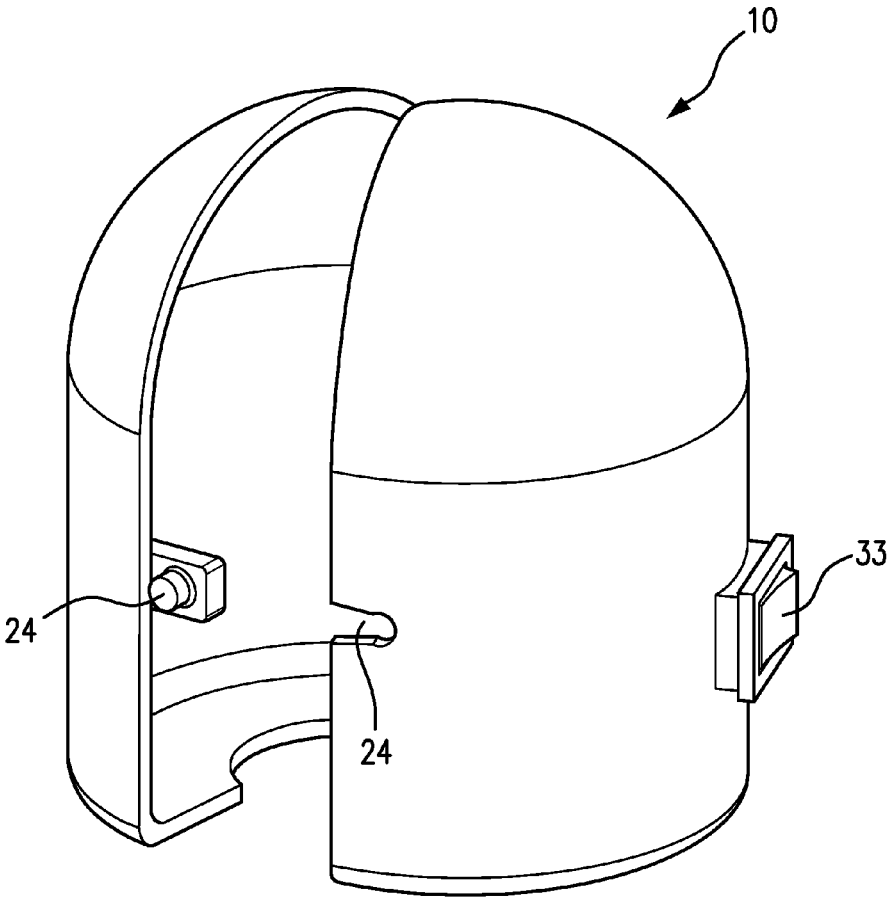
FIG. 3 is a perspective view of an exemplary protective tent stake cap in a partially open position with an exterior rocker switch for an interior LED light.
Figure 4:
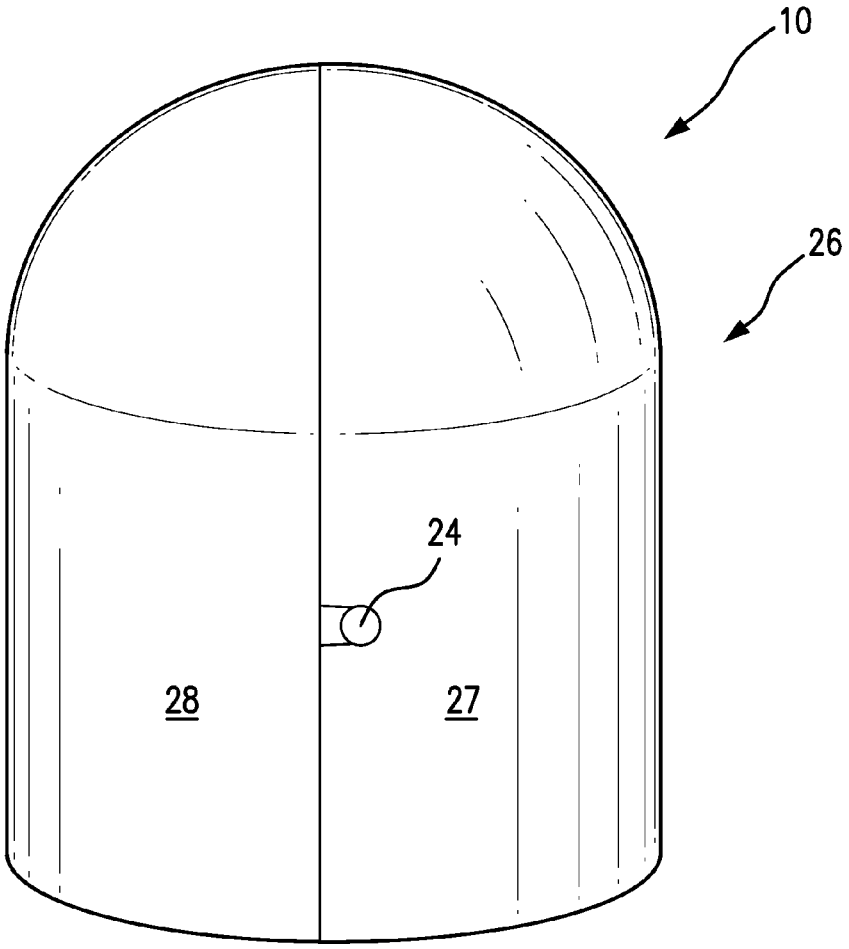
FIG. 4 is a perspective view of an exemplary protective tent stake cap in an closed position.

The protective cap 10 further comprises two bilateral partitions 20, consisting of a first partition 21 and a second partition 22, wherein the bilateral partitions are connected on a distal side by a hinge 23 and are releasably connectible on a proximal side by a connective mechanism, such as the button catch 24 depicted in FIGS. 1-3. When the connective mechanism 24 is released, the bilateral partitions 20 are mutually rotatable apart about the hinge 23, so as to put the enclosure 11 into an open position 25, as depicted in FIGS. 1 and 2. In the open position 25, the axial aperture 16 is bifurcated so as to allow the stake head to be inserted into the base compartment space 19. With the stake head inserted into the base compartment space 19, the bilateral partitions 20 are mutually rotatable together about the hinge 23 and are securable together by the connective mechanism 24, so as to put the enclosure 11 into a closed position 26, as depicted in FIG. 4, in which position the stake head is enclosed by the protective cap 10.

As shown in FIGS. 1 and 2, the bilateral partitions 20 can be asymmetrical, such that the first partition 21 is larger than the second partition 22, or vice-versa, and such that one of the partitions is a larger partition 27 and the other is a smaller partition 28. In one embodiment of the protective cap 10, as depicted in FIG. 2, the middle compartment space 18 within the larger partition 27 contains a battery compartment 29, which serves to secure one or more batteries 30 as an electrical power source for an LED 31 located in the domed compartment space 17 of the larger partition 27. In this embodiment, an electrical connection between the batteries 30 and the LED 31 is provided by a button contact switch 32, which extends between the battery compartment 29 and the base compartment space 19 of the larger partition 27 and activates the electrical connection upon being engaged by the stake head. As shown in FIG. 3, an alternate or additional electrical connection between the batteries 30 and the LED 31 can be provided by a external switch 33 located on the enclosure wall 14.

In the LED-lighted embodiments of the protective cap 10, the upper dome 13 of the enclosure 11 is translucent or transparent, so that the light emitted by the LED 31 is visible outside the enclosure 11 and serves to render the tent stake more noticeable by passers-by, so as to minimize the tripping hazard.

Although the preferred embodiments of the present invention have been disclosed for illustrative purposes, those skilled in the art will appreciate that many additions, modifications and substitutions are possible, without departing from the scope and spirit of the present invention as defined by the accompanying claims.

What is claimed is:

1. A protective tent stake cap apparatus, comprising:

a protective cap in combination with a tent stake having a convex stake head and a substantially cylindrical or tapered cylindrical shank, in which the stake head has a diameter and the shank has a diameter that is smaller than the diameter of the stake head;

wherein the protective cap comprises a rigid plastic, bilaterally-hinged, sphero-cylindrical enclosure, which defines a sphero-cylindrical interior compartment, wherein the enclosure comprises an upper dome, a cylindrical wall and a flat circular base, which base has a circular axial aperture that accesses the interior compartment, and wherein the axial aperture has a diameter that is less than the diameter of the stake head but greater than the diameter of the shank, and wherein the interior compartment comprises an upper domed compartment space, a middle compartment space and a base compartment space;

wherein the protective cap further comprises two bilateral partitions, consisting of a first partition and a second partition, and wherein the bilateral partitions are connected on a distal side by a hinge and are releasably connectible on a proximal side by a connective mechanism, such that, when the connective mechanism is released, the bilateral partitions are mutually rotatable apart from one another about the hinge, so as to put the enclosure into an open position, in which open position the axial aperture is bifurcated so as to allow the stake head to be inserted into the base compartment space, and such that, with the stake head inserted into the base compartment space, the bilateral partitions are mutually rotatable together about the hinge and are securable together by the connective mechanism, so as to put the enclosure into a closed position, in which position the stake head is enclosed by the protective cap, such that the protective cap is secured from sliding off the tent stake due to the larger diameter of the enclosed stake head in relation to the diameter of the axial aperture.

2. The protective cap of claim 1, wherein the bilateral partitions are asymmetrical, such that one of the partitions is a larger partition and the other is a smaller partition.

3. The protective cap of claim 2, wherein the domed compartment space of the larger partition contains one or more LEDs, and wherein the middle compartment space within the larger partition contains a battery compartment, which serves to secure one or more batteries as an electrical power source for the one or more LEDs, and wherein the upper dome of the enclosure is translucent or transparent so that illumination of the one or more LEDs is transmitted outside the enclosure so as to render the tent stake more visible and to thereby reduce tripping hazards associated with the tent stake.

4. The protective cap of claim 3, wherein an electrical connection between the batteries and the one or more LEDs is provided by a button contact switch, which extends into the base compartment space of the larger partition and activates the electrical connection upon being engaged by the stake head.

5. The protective cap of claim 3, wherein an electrical connection between the batteries and the LEDs is provided by a manually operable external switch located on the wall of the enclosure.

6. The protective cap of claim 3, wherein an electrical connection between the batteries and the LEDs is provided by a light sensor switch, such that the LEDs are extinguished during daylight conditions and are illuminated during night or darkness conditions.

* * * * *